US006409025B1

(12) United States Patent
Moon

(10) Patent No.: US 6,409,025 B1
(45) Date of Patent: Jun. 25, 2002

(54) GUARD FOR RESTRICTING ACCESS TO A RACK OF GOODS

(76) Inventor: John P Moon, 4407 Woodfield Dr., Hahira, GA (US) 31632

( * ) Notice: Subject to any disclaimer, the term of this patent is extended or adjusted under 35 U.S.C. 154(b) by 0 days.

(21) Appl. No.: 09/792,086

(22) Filed: Feb. 23, 2001

(51) Int. Cl.[7] ..... E05B 73/00
(52) U.S. Cl. ..... 211/4
(58) Field of Search ..... 211/4, 183; 248/551; 70/77, 78; 312/114, 118, 122, 350

(56) References Cited

U.S. PATENT DOCUMENTS 5,332,105 A * 7/1994 Stanfield
5,513,580 A 5/1996 Franks
6,138,483 A * 10/2000 Galant
6,139,034 A 10/2000 Williams
6,205,823 B1 * 3/2001 Volk, Sr.

* cited by examiner

*Primary Examiner*—Alvin Chin-Shue
*Assistant Examiner*—Sarah Purol
(74) *Attorney, Agent, or Firm*—Roberts, Mlotkowski and Hobbes, P.C.; Laurence P. Hobbes

(57) ABSTRACT

A guard restricting access to a rack of goods comprises: an access-restricting cover having an open bottom, a left side to which is substantially vertically mounted a track means, and a right side to which is substantially vertically mounted a track means; a left extensible member comprising a track means which is lockably engageable with the track means of said left side so as to slide said left extensible member from a retracted storage position to an extended use position; a right extensible member comprising a track means which is lockably engageable with the track means of said right side so as to slide said right extensible member from a retracted storage position to an extended use position; and a bottom member having a left end reversibly securable to a lower end of said left extensible member, and a right end reversibly securable to a lower end of said right extensible member.

19 Claims, 2 Drawing Sheets

GUARD FOR RESTRICTING ACCESS TO A RACK OF GOODS

BACKGROUND OF THE INVENTION

A. Field of the Invention

The present invention relates to a guard for restricting access to a rack of goods. The guard is especially suited to prevent unauthorized removal of bottles from a rack.

B. Description of the Prior Art

Pilferage losses can substantially affect the profitability of retail businesses. This is especially true in food and beverage service industries where constant monitoring of employees can be difficult. Unauthorized access or even the threat of such access in a retail establishment can necessitate repeated inventorying of stock to detect and deter losses of inventory, especially losses occurring after business hours when management presence is reduced. In restaurant or bar businesses costly measures are often taken to secure inventories of alcoholic beverages. Often, such businesses secure their inventory sitting in wells at the bar after hours by putting up liquor bottles in a separate location which is securable, e.g., a locked cage. However, there are disadvantages associated with these precautions, e.g., handling costs and associated breakage, as well as a need for increased secured storage space. Accordingly, it would be useful to secure inventory from its site of dispensation, e.g., liquor bottles at the bar.

Various efforts have been made in the past to reduce the opportunity to pilfer inventory. For example, U.S. Pat. No. 6,139,034 to Williams discloses a food service cart for airplanes with a vertically slidable latching mechanism for its doors which is securable by a padlock. U.S. Pat. No. 5,513,580 to Franks discloses a lockbox or safe which comprises extensions which are expandable or retractable when the box is open which serve to secure the box in a confined space.

In applications where bottles are stored in a floored platform such as a deep well, it would be desirable to provide a means to restrict access to the bottles in the well by a self-contained, stand-alone device which does not require any modification to the well holding the bottles, e.g., by adding attachment points to the sides. In particular, it would be useful to provide a means for restricting access which is secured along the underside of the platform or well. However, such an arrangement requires that the means to restrict access be sufficiently deep to surround both the top and bottom of the well or loaded platform, requiring excessive space to store the device when not in use. Accordingly, it would be useful to provide a guard to restrict access to goods which is extended when used but collapsed for storage and shipping.

SUMMARY OF THE INVENTION

In one aspect, the present invention relates to a guard for restricting access to a rack of goods which comprises:

i) an access-restricting cover having an open bottom, a left side to which is substantially vertically mounted a track means, and a right side to which is substantially vertically mounted a track means;

ii) a left extensible member comprising a track means which is lockably engageable with the track means of said left side so as to slide said left extensible member from a retracted storage position to an extended use position;

iii) a right extensible member comprising a track means which is lockably engageable with the track means of said right side so as to slide said right extensible member from a retracted storage position to an extended use position; and iv) a bottom member having a left end reversibly securable to a lower end of said left extensible member, and a right end reversibly securable to a lower end of said right extensible member.

In another aspect, the present invention relates to a guard for securing a rack of goods which comprises:

a) an access-restricting left vertical side member to which is substantially vertically mounted an engageable track means;

b) an access-restricting right vertical side member to which is substantially vertically mounted an engageable track means;

c) an access-restricting front member at least partially disposed between or upon, and attachable to, said side members;

d) an access-restricting rear member at least partially disposed between or upon, and attachable to, said side members;

e) an access-restricting upper member at least partially disposed between or upon, and attachable to, said side members;

f) a left extensible member comprising a track means which is engageable with the track means of said left vertical side member so as to slide said left extensible member from a retracted storage position to an extended use position, and a left flexible strap affixable to the lower end of said left extensible member;

g) a right extensible member comprising a track means which is engageable with the track means of said right vertical side member so as to slide said right extensible member from a retracted storage position to an extended use position; and a right flexible strap affixable to the lower end of said right extensible member;

h) a bottom member having a left end reversibly securable to said left flexible strap, and a right end reversibly securable to said right flexible strap.

In still another aspect, the present invention relates to a securable bottle storage system which comprises I) a rack comprising a floor, capable of receiving at least one row of upright standing bottles; and II) a lockable guard securable over said rack which comprises a) an access-restricting cover having an open bottom, a left side to which is substantially vertically mounted a track means, and a right side to which is substantially vertically mounted a track means;

b) a left extensible member comprising a track means which is lockably engageable with the track means of said left side so as to slide said left extensible member from a retracted storage position to an extended use position;

c) a right extensible member comprising a track means which to is lockably engageable with the track means of said right side so as to slide said right extensible member from a retracted storage position to an extended use position; and d) a bottom member having a left end reversibly securable to a lower end of said left extensible member, and a right end reversibly securable to a lower end of said right extensible member, said bottom member locatable beneath said floor of said rack.

BRIEF DESCRIPTION OF THE DRAWING

This invention, and the advantageous features thereof, will be more completely understood when considered in context with the following detailed description, which includes a description of the attached drawing, wherein.

DETAILED DESCRIPTION OF THE INVENTION

Although the present invention is particularly useful and described in connection with the storage of liquor bottles, it will be apparent that it can be used for the protected storage of any type of bottles or other items which are placed in a floored holder or rack.

The guard of the present invention prevents unauthorized access to goods, e.g., opened bottles of liquors by employees and ancillary personnel such as cleaning crews. The present invention provides a means to secure bottles where they sit in their wells at a bar, removing the need to put up the bottles in a separate, secured location.

Figure 1:
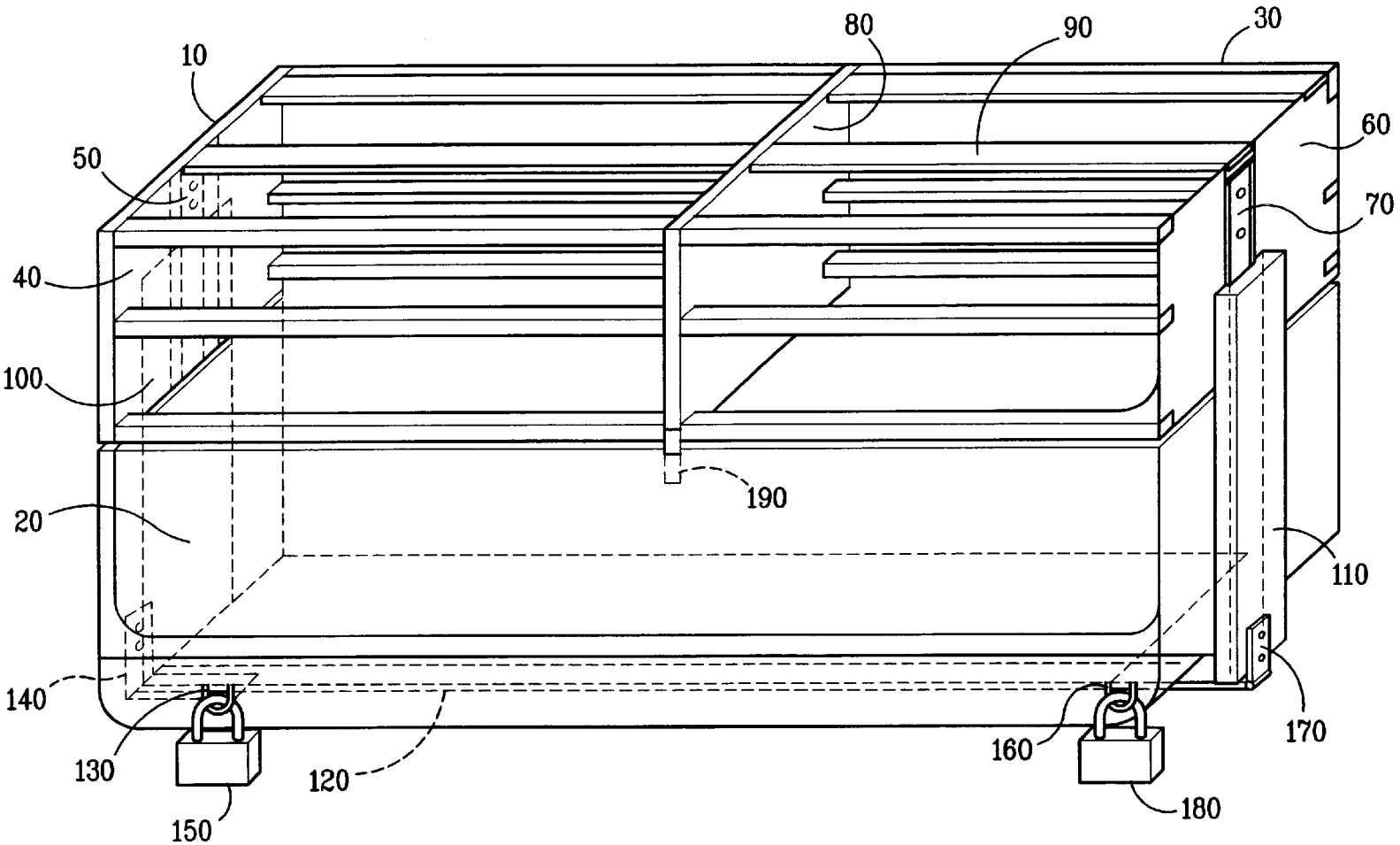
FIG. 1 illustrates a perspective view of an embodiment of the invention in its extended use configuration placed and secured over a liquor well.
Figure 2:
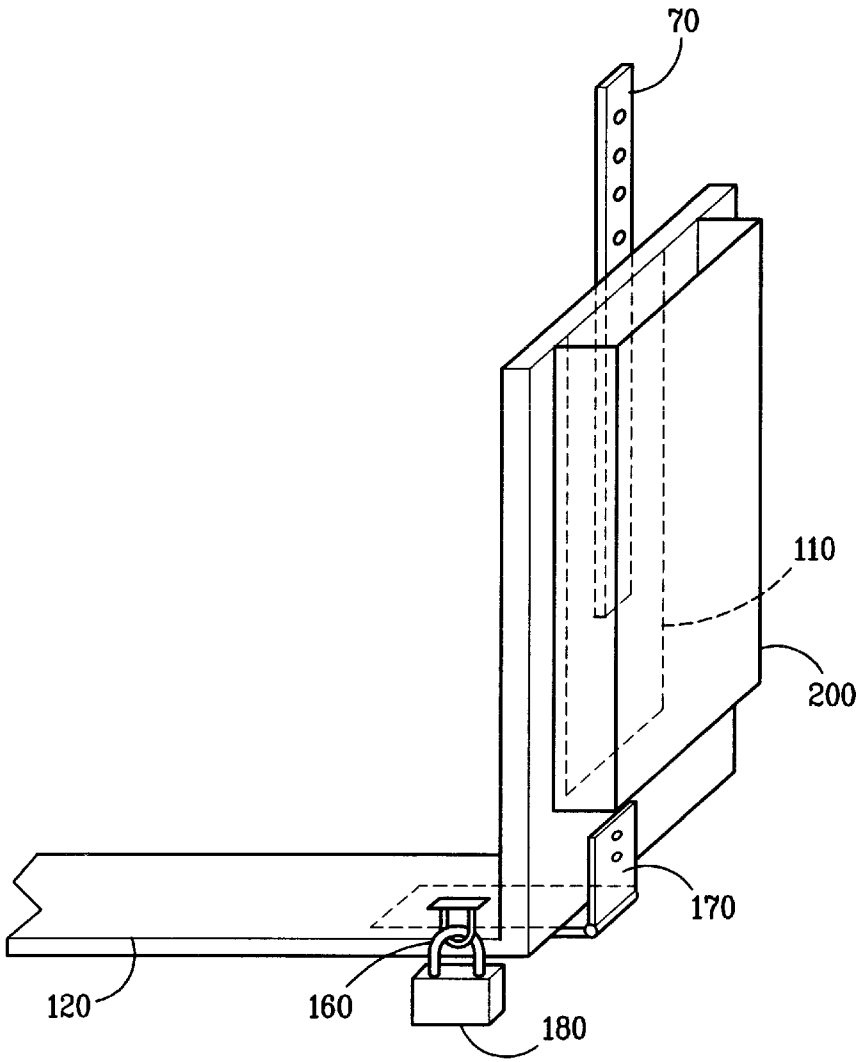
FIG. 2 illustrates a detailed perspective view of the right side cooperating extending members and the securing of the bottom member with a hasp and padlock.

FIG. 1 illustrates a frontal perspective view of an embodiment of the present invention in the extended configuration employed when in use. FIG. 2 provides a more detailed perspective view of the cooperating right extending member, right track means and bottom member of the present invention. This illustrated embodiment is described in detail below.

FIG. 1 depicts a guard 10 of the present invention set in place over a well 20 which can act as a rack for goods such as liquor bottles (not shown). The guard comprises an access-restricting cover 30 having an open bottom, a left side member 40 to which is substantially vertically mounted a left track means 50, and a right side member 60 to which is substantially vertically mounted a right track means 70. One or more optional support members 80 can be placed at a point or points between the side members. Securably attached to exposed top, front and rear surfaces of the side members and any support members are access-restricting elements 90 such as a plurality of stringers spaced sufficiently apart to restrict access to an interior space within the guard. Access should be restricted by placing the stringers sufficiently apart from one another to prevent withdrawal of the goods through the guard. The stringers can be made of any suitably sturdy material, e.g., wood, metal, plastic or fiberglass. Alternately, sheets of access-restricting material may be applied such as plywood or preferably, transparent sheets of durable materials such as plexiglass, or combinations of such materials. A left extensible member 100 comprises a track means which is lockably engageable with the track means of the left side 50 so as to slide the left extensible member from an upward retracted storage position to a downward extended use position. Similarly, a right extensible member 110 comprises a track means, lockably engageable with the track means of the right side 70 so as to slide said right extensible member from an upward retracted storage position to a downward extended use position. Each extensible member can comprise a track means mounted on a separate reinforcing member which imparts further strength to the guard. The guard can also comprise stop means which limits extension of the extensible members. For example, each extensible member may comprise a stop means which prevents extension of the bottom of the member substantially beyond the lowermost level of the well or platform which is to be protected by the guard means. Such a stop means may simply be a protrusion on the outer surface of the reinforcing member which restrains further movement of the extensible member as it contacts an obstruction mounted on lower portion of the guard, e.g., on the side member.

The combined extensible members 100 and 110 and track means 50 and 70 can be any suitable cooperating sliding, leaved, or telescoping combination capable of linear movement, e.g., a drawer slide assembly can be mounted to impart the desired extensibility to the guard of the present invention. Examples of suitable drawer slide assemblies for use in the present invention include Models 3832B, 3834B, or 3837B 32MM Full Extension Drawer Slide available from Accuride International, Inc. of Santa Fe Springs, Calif. In instances where a disconnect lever is exposed and accessible in the drawer slide combination as installed, it would be desirable to remove or otherwise disable such disconnecting means in order to prevent removal of the extensible member from the installed track means which defeats the purpose of the present invention by permitting unauthorized removal of the guard of the present invention.

A bottom member 120 has mounted at its left end a securing means 130 such as a staple, reversibly securable to a lower end of the left extensible member 100 through a securing means 140 such as a flexible strap which contains an aperture through which the staple can protrude when the strap is folded 90 degrees. A left locking means 150 such as a padlock can be passed through the staple which protrudes through the folded over strap to secure the bottom member to the left extensible member. Similarly, the bottom member 120 has mounted at its right end a securing means 160 such as a staple, reversibly securable to a lower end of the right extensible member 110 through a securing means 170 such as a flexible strap which contains an aperture through which the staple can protrude when the strap is folded 90 degrees. A right locking means 180 such as a padlock can be passed through the staple which protrudes through the folded over strap to secure the bottom member to the right extensible member. Alternately, the staples can be mounted on the extensible members while the flexible or hinged strap can be mounted on the bottom member. The flexible straps can be comprised of any suitable material of sufficient durability such as metal, plastic or fiberglass. Especially preferred are hinged metal straps attached to the outside surface of the extensible members which cooperate with staples attached to the bottom member to provide a hasp which is reversibly securable by padlock.

In any event, this configuration provides a reversibly securable means for connecting the extensible members to the bottom member which is positioned underneath the rack or well which holds the goods to be secured. Suitable means for reversibly securing the bottom member to the extensible members can include means selected from the group consisting of padlock and hasp, deadbolt, and cam lock.

The guard can be prevented from sliding over the well or platform which it protects by means of one or more anti-sliding dogs 190 which are mounted on the guard's outer surfaces so as to abut an interior surface of the well when the guard is in place. Preferably the dogs are mounted in pairs on opposite sides. For example, the dogs could advantageously be mounted at or near the four corners of the guard.

As shown in FIG. 2, for additional security, a covering structure 200 such as a box can be attached to the outside surface of the extending member so as to prevent access to the screws or other fastening means which attach the track means of the extensible member to the inside surface of the extending member.

The guard of the present invention can assume any shape necessary to protect the goods as stored and used. The cover of the guard can be shaped to conform to a terraced arrangement of goods or a terraced arrangement of bottles as are commonly employed in bars and restaurants.

While the invention has been described herein in terms of various preferred embodiments, those skilled in the art will recognize that various changes and modifications can be made without departing from the spirit and scope of the invention, as defined in the following claims.

What is claimed is:

1. A guard for restricting access to a rack of goods which comprises:

i) an access-restricting cover having an open bottom, a left side to which is substantially vertically mounted a left side track means, and a right side to which is substantially vertically mounted a right side track means;

ii) a left extensible member comprising a left extensible member track means which is lockably engageable with the left side track means so as to slide said left extensible member from a retracted storage position to an extended use position;

iii) a right extensible member comprising a right extensible member track means which is lockably engageable with the right side track means so as to slide said right extensible member from a retracted storage position to an extended use position; and iv) a bottom member having a left end reversibly securable to a lower end of said left extensible member, and a right end reversibly securable to a lower end of said right extensible member.

2. The guard of claim 1 wherein said track means are drawer slides.

3. The guard of claim 1 which comprises stop means which limits extension of said extensible members.

4. The guard of claim 1 which comprises one or more anti-sliding dogs.

5. The guard of claim 1 wherein said bottom member is reversibly securable to at least one of said extensible members by a reversibly securing means which is selected from the group consisting of padlock and hasp, deadbolt, and cam lock.

6. The guard of claim 1 wherein said cover is shaped to conform to a terraced arrangement of goods.

7. The guard of claim 1 wherein said cover is shaped to conform to a terraced arrangement of bottles.

8. A guard for securing a rack of goods which comprises a) an access-restricting left vertical side member to which is substantially vertically mounted an engageable left vertical side member track means;

b) an access-restricting right vertical side member to which is substantially vertically mounted an engageable right vertical side member track means;

c) an access-restricting front member at least partially disposed between or upon, and attachable to, said side members;

d) an access-restricting rear member at least partially disposed between or upon, and attachable to, said side members;

e) an access-restricting upper member at least partially disposed between or upon, and attachable to, said side members;

f) a left extensible member comprising a left extensible member track means which is engageable with said left vertical side member track means so as to slide said left extensible member from a retracted storage position to an extended use position, and a left flexible strap affixable to the lower end of said left extensible member;

g) a right extensible member comprising a right extensible member track means which is engageable with said right vertical side member track means so as to slide said right extensible member from a retracted storage position to an extended use position; and a right flexible strap affixable to the lower end of said right extensible member; and h) a bottom member having a left end reversibly securable to said left flexible strap, and a right end reversibly securable to said right flexible strap.

9. The guard of claim 8 wherein said flexible straps are hinged metal straps which cooperate with staples attached to said bottom members to provide a hasp which is reversibly securable by padlock.

10. The guard of claim 8 wherein at least one of said front member, rear member and upper member comprise a plurality of stringers spaced sufficiently apart to restrict access to an interior space within said guard.

11. A securable bottle storage system which comprises

I) a rack comprising a floor, capable of receiving at least one row of upright standing bottles; and II) a lockable guard securable over said rack which comprises a. an access-restricting cover having an open bottom, a left side to which is substantially vertically mounted a left side track means, and a right side to which is substantially vertically mounted a right side track means;

b. a left extensible member comprising a left extensible member track means which is lockably engageable with the left side track means so as to slide said left extensible member from a retracted storage position to an extended use position;

c. a right extensible member comprising a right extensible member track means which is lockably engageable with said right side track means so as to slide said right extensible member from a retracted storage position to an extended use position; and d. a bottom member having a left end reversibly securable to a lower end of said left extensible member, and a right end reversibly securable to a lower end of said right extensible member, said bottom member locatable beneath said floor of said rack.

12. The system of claim 1 wherein said guard means comprises stop means which limits extension of said extensible members.

13. The system of claim 11 wherein said track means are drawer slides.

14. The system of claim 11 wherein said reversibly securing means is selected from the group consisting of padlock and hasp, deadbolt, and cam lock.

15. The system of claim 11 wherein said bottom member is reversibly securable to at least one of said extensible members by a reversibly securing means which comprises padlock and hasp.

16. The system of claim 11 wherein said cover is shaped to conform to a terraced arrangement of goods.

17. The system of claim 11 wherein said cover is shaped to conform to a terraced arrangement of bottles.

18. The system of claim 11 wherein said rack is a well.

19. The system of claim 11 wherein a covering structure is mounted on the outside surface of said extendible members.

* * * * *